United States Patent [19]

Titus et al.

[11] Patent Number: 4,480,906

[45] Date of Patent: Nov. 6, 1984

[54] APPARATUS FOR MOUNTING DISCRETE IMAGE CARRIER SHEETS FOR MOVEMENT IN AN ELECTROGRAPHIC COPIER

[75] Inventors: Rex S. Titus; Robert J. Kindt, both of Rochester; Robert M. Peffer, Penfield, all of N.Y.

[73] Assignee: Eastman Kodak Company, Rochester, N.Y.

[21] Appl. No.: 427,239

[22] Filed: Sep. 29, 1982

[51] Int. Cl.[3] ..... G03G 15/00

[52] U.S. Cl. ..... 355/3 R; 355/4; 198/345

[58] Field of Search ..... 355/3 R, 4, 16, 72; 198/345, 648

[56] References Cited

U.S. PATENT DOCUMENTS

| | | | |
|---|---|---|---|
| 296,868 | 4/1884 | Nunan . | |
| 2,339,494 | 1/1944 | Lubahn . | |
| 3,148,600 | 9/1964 | Bain | 355/16 X |
| 3,550,535 | 12/1970 | Rooklyn . | |
| 3,575,281 | 4/1971 | Sutton . | |
| 3,927,814 | 12/1975 | Holm . | |
| 4,017,171 | 4/1977 | Wicket et al. . | |

*Primary Examiner*—John F. Gonzales
*Assistant Examiner*—J. Pendegrass
*Attorney, Agent, or Firm*—Lawrence P. Kessler

[57] ABSTRACT

For use in an electrographic copier having a track assembly with multiple tracks defining a path associated with the copier process stations through which discrete image carrier sheets are moved to form developed images on such sheets, apparatus for mounting such sheets for movement along selected tracks of such track assembly. Supports, such as rigid rectangular frames, hold discrete image carrier sheets respectively in a substantially planar condition. The sheet supports include mechanisms for engaging selected tracks of the track assembly. The mechanisms movably mount supported sheets, when moving along a portion of the track assembly path, in the same plane relative to that portion of the path regardless of the selected track with which they are engaged.

7 Claims, 10 Drawing Figures

APPARATUS FOR MOUNTING DISCRETE IMAGE CARRIER SHEETS FOR MOVEMENT IN AN ELECTROGRAPHIC COPIER

BACKGROUND OF THE INVENTION

This invention relates generally to discrete sheet mounting apparatus, and more particularly to apparatus for mounting discrete image carrier sheets for movement about selected tracks of an electrographic copier.

In U.S. Pat. No. 4,436,405 issued Mar. 13, 1984 in the names of Kindt et al, an electrographic copier is disclosed for making multicolor reproductions. In such copier, electrostatic charge patterns, corresponding to primary color separation images of information to be reproduced (plus an image of black information such as line copy), are respectively formed on image carriers, such as discrete photoconductive film sheets. The film sheets travel seriatim in a track assembly having multiple tracks defining a path associated with the electrographic process stations. The process station for developing the charge patterns has a plurality of parallel developer assemblies containing electroscopic marking particles. With the subtractive color printing process, the particles correspond respectively to the complements of the colors to be reproduced (plus black). The film sheets are respectively routed to the developer assemblies where development of such patterns, to form transferable images, takes place in parallel.

After development the film sheets are routed to a transfer station where the transferable images are transferred seriatim in accurate superimposed register to a receiver member. The transferred images are fixed (fused) to the receiver member by heat and pressure for example, to form the reproduction. It is important that each of the film sheets exhibit the same operative relation to the respective process stations in order that the functions provided by such stations are performed in a like manner on each sheet. Additionally each sheet must be readily transportable to its respective developer assembly.

SUMMARY OF THE INVENTION

This invention is directed to apparatus for mounting discrete image carrier sheets for movement respectively about selected tracks of a track assembly defining a path associated with process stations of an electrographic copier to form developed images on such sheets. Supports, such as rigid rectangular frames, hold discrete image carrier sheets respectively in a substantially planar condition. The sheet supports include mechanisms for engaging selected tracks of the track assembly. The mechanisms movably mount supported sheets, when moving along a portion of the track assembly path, in the same plane relative to that portion of the path regardless of the selected track with which they are engaged.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DESCRIPTION OF THE PREFERRED EMBODIMENTS

Figure 6:
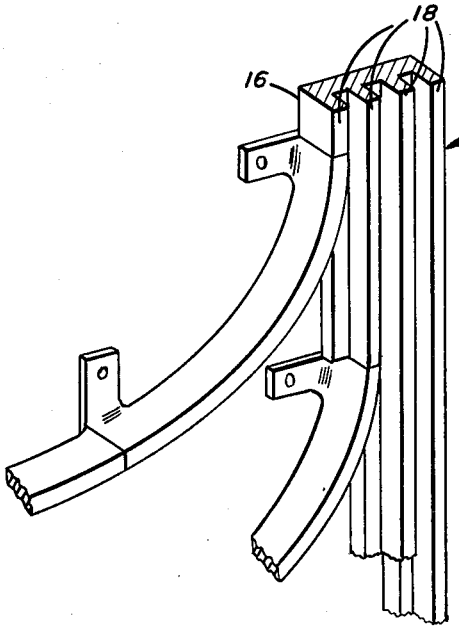
FIG. 6 is a view in perspective of a portion of the image carrier sheet track assembly, including a transition section.

Referring now to the accompanying drawings, FIGS. 1–4 show apparatus 10 for mounting discrete image carrier sheets (e.g., sheet 12) for movement about a track assembly 14 of an electrographic copier. The track assembly 14 defines a continuous path operatively associated with process stations of a copier E such as shown schematically in FIG. 5, and more fully described in the aforementioned U.S. Pat. No. 4,436,405. The charging, exposure, transfer, and cleaning process stations perform their respective functions in a like manner on each film sheet. The process station for development has a plurality of developer assemblies which respectively perform their function only on certain sheets. The track assembly 14 includes a pair of opposed parallel rails 16 having a plurality of tracks 18. The tracks 18 are parallel adjacent to the charging, exposure, transfer, and cleaning stations, and branch off into plural path segments respectively associated with the developer assemblies of the developer station. An exemplary transition section for the branching of the tracks 18 is shown in FIG. 6.

The image carrier sheets are discrete substantially rectangular sheets of insulative polyester film having a layer of photoconductive material and a grounded layer of conductive material, such as shown for example in U.S. Pat. No. 3,615,414 issued Oct. 26, 1971 in the name of Light. Each sheet is, for example, adhesively bonded to a respective rectangular rigid frame 20 to hold the sheets in a planar condition (i.e., flat). The frame 20 includes angle braces 22 located at the corners of opposed marginal edges of the frame. Supports 24, fixed to the braces 22, are respectively perpendicular to the plane of the sheet 12. A drive mechanism 26 cooperates with at least one of the supports 24 for moving the frame 20 along the path described by the track assembly 14. In the illustrative embodiment the drive mechanism 26 is a belt moving in a path parallel to the track assembly path (including the branched portions of such path). The belt has projecting teeth 28 and one of the supports 24 (lower right in FIG. 1) has an integral member 30 with projecting teeth 32 mating with the teeth 28. Of course, other drive mechanisms, such as friction drive rollers, are suitable for use with this invention.

The supports 24 include adjustable positioning mechanisms 34 which engage selected tracks 18 of the track assembly 14. The mechanisms 34 are adjusted to locate a frame 20 relative to a selected track 18 to maintain the supported image carrier sheet, when moving along a portion of the track assembly path where the tracks 18 are parallel (see FIG. 3 for example), in the same plane P relative to that portion of the path regardless of the selected track with which they are engaged. In the branched portion of the track assembly 14, the mechanisms 34 follow the selected track to move the frame 20 (and its supported sheet) to its associated developer assembly.

Figure 1:
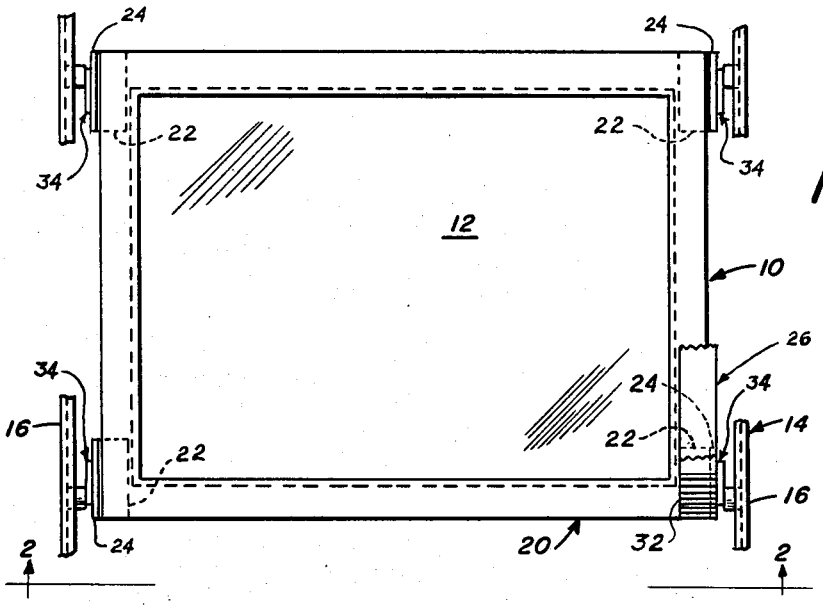
FIG. 1 is a top plan view of a discrete image carrier sheet and its mounting apparatus according to this invention.
Figure 2:
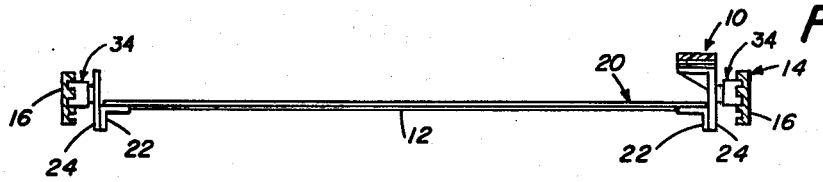
FIG. 2 is a front elevational view of the structure of FIG. 1 taken along lines 2—2 of FIG. 1.
Figure 3:
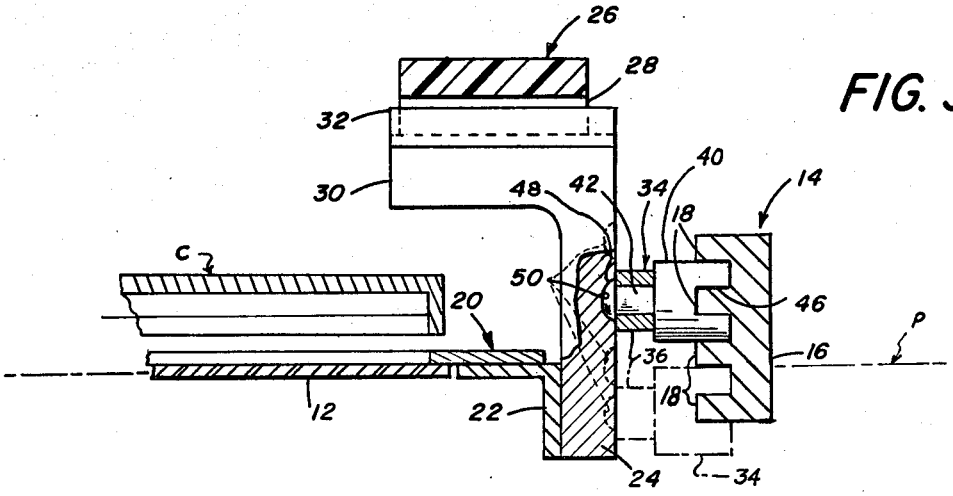
FIG. 3 is a front elevational view of a portion of the structure of FIG. 2, on an enlarged scale, with portions broken away or removed to facilitate viewing.

The frame-supported image carrier sheets are maintained in plane P to insure that each sheet is respectively transported into the same operative relation with the like functioning process stations. That is, each of the sheets is moved into such process stations in the same relative position to the respective stations. This insures that the function provided by the respective stations operate on each of such sheets in a like manner. For example, as shown in FIG. 3, in the charging station, each sheet lies in plane P as it is transported past the charger C and is uniformly spaced from such charger. Therefore, the electrostatic charge placed on each sheet by the charger is equal.

Figure 4:
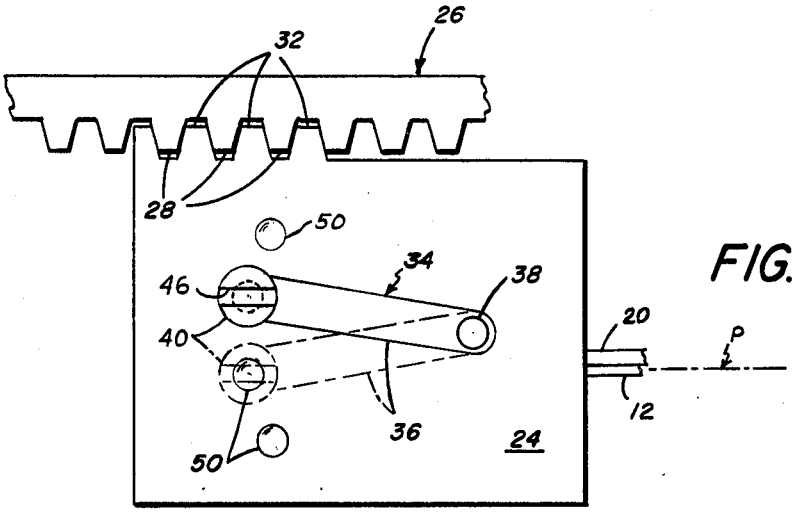
FIG. 4 is a side elevational view of the structure of FIG. 3.
Figure 5:
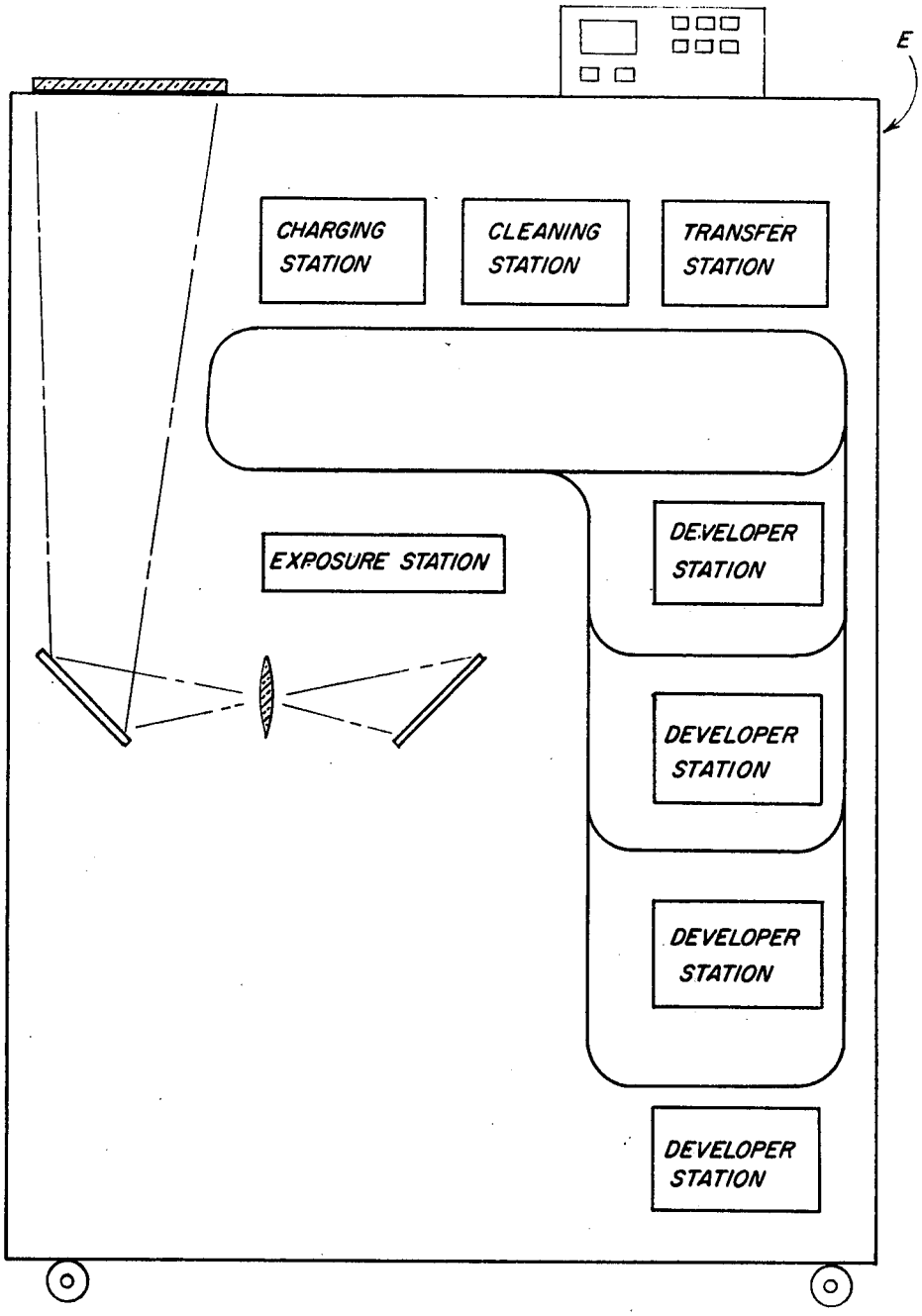
FIG. 5 is a schematic side elevational view, in cross-section of an electrographic copier utilizing discrete image carrier sheets mounted for movement to the copier process stations by the apparatus according to this invention.

The adjustable positioning mechanisms 34 located along one side of each frame 20 are identical, while those located along the opposite side are mirror images thereof. Therefore, only the mechanism associated with the driven support 24 (bottom right hand support of FIG. 1) is shown in FIGS. 3 and 4 and described hereinbelow. The mechanism 34 includes an arm 36. The arm 36 is pivotally supported adjacent to one end on a pin 38 mounted on the support 24, and rotatably carries a pin 42 adjacent its opposite end. A follower 40, fixed to one end of the pin 42, has a groove 46 which is configured to mate with a track 18. The opposite end of the pin 42 has a head 48 in juxtaposition to the support 24. The support has a plurality of detents 50, configured to mate with the head 48, for selectively setting the angular orientation of the arm 36 about its pin 38. The detents 50 are vertically spaced apart a distance equal to the distance between corresponding points on adjacent tracks 18. Further, the detents are in vertically spaced relation to the plane P to correspond to selected tracks 18 respectively whereby when the head 48 mates with a particular detent 50, the groove 46 is matable with a corresponding selected track 18 to locate the supported image carrier sheet in the plane P.

For a particular frame 20, the angular orientation of arms 36 are set by pivoting the arms about respective pins 38 to mate heads 48 with similarly located detents 50 on the supports 24. Such frame is then inserted in the track assembly 14 with the grooves 46 of the followers 40 mating with a corresponding selected track 18. In the solid line position of the mechanism 34 shown in FIG. 3 and 4, head 48 mates with the detent second from the top and the groove 46 mates with the track second from the top; and in the broken line position, head 48 mates with the bottom detent and the groove 46 mates with the bottom-most track. The image carrier sheets supported by respective frames are thus in the same plane P relative to the parallel portion of the track assembly 14. Accordingly, as the frames are driven, their associated followers 40 traverse the selected track 18 and the sheets are respectively brought into the same operative relation with the aforementioned like functioning process stations. In the transition sections (for example, as shown in FIG. 6) to the branched portion of the path, the followers rotate relative to their respective frames to facilitate movement of the frame through such transition sections toward the appropriate developer assemblies.

Figure 7:
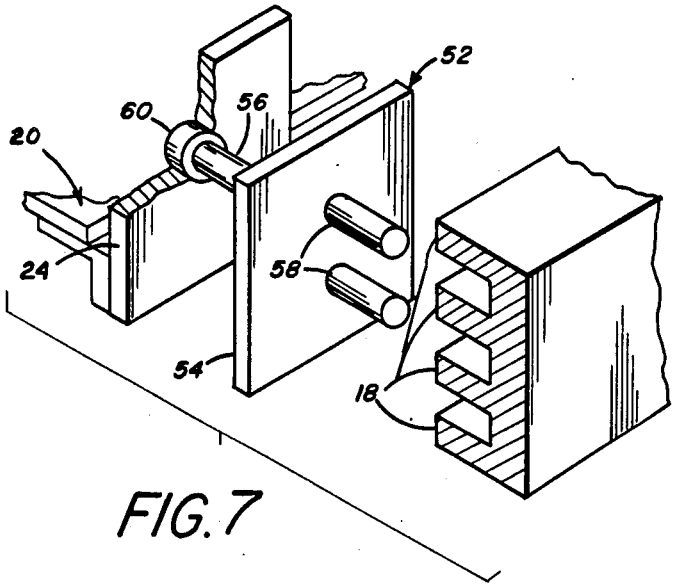
FIG. 7 is a view in perspective of an alternate embodiment of a portion of the mounting apparatus according to this invention.
Figure 7A:
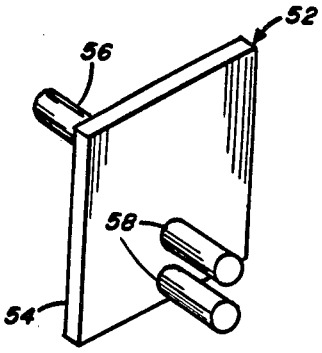
FIG. 7*a* is a view similar to FIG. 7 with such portion adapted to engage a different track.

In the alternate embodiment shown in FIGS. 7, 7*a* each of the mechanisms 34 (of FIGS. 1–4) are replaced by a member 52. The member 52 includes a plate 54 having a support axle 56 extending from one face of the plate. The axle 56 is rotatably mounted in a bearing 60 carried by the support 24. A set of pins 58, extending from the opposite face of the plate, are spaced apart a distance substantially equal to the width of an individual rail of track 18 to capture the track rail therebetween. The sets of pins 58 are located in vertically spaced relation to the plane of the supported image carrier sheet to locate such sheet in the Plane P when the pins capture a corresponding selected track rail. For example, the pins in FIG. 7 are located to position the respective supported sheet in plane P when they capture the second track rail from the top; and the pins in FIG. 7*a* are located to position the respective supported sheet in plane P when they capture the bottom-most track rail. The pins 58 facilitate the following of the track assembly by the frame 20, particularly around corners such as in a transition section.

Figure 8:
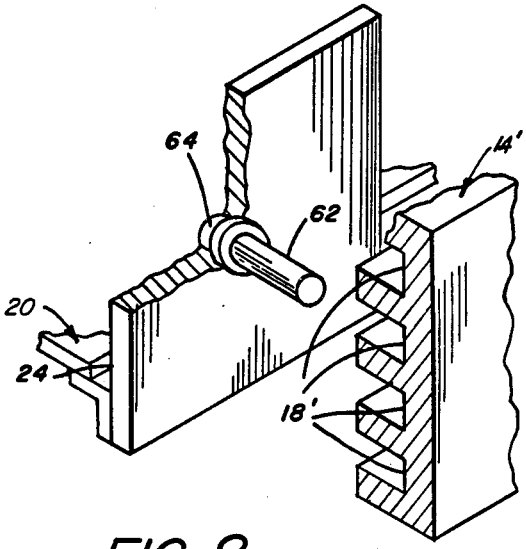
FIG. 8 is a view in perspective of another alternate embodiment of a portion of the mounting apparatus according to this invention.
Figure 8A:
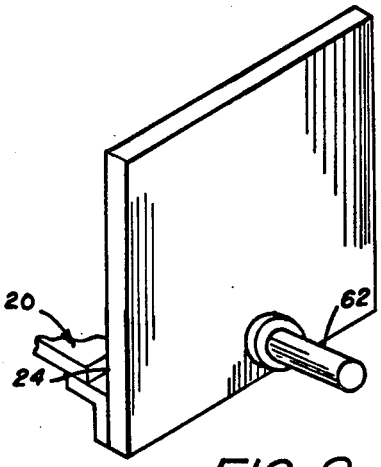
FIG. 8*a* is a view similar to FIG. 8 with such portion adapted to engage a different slotted track.

In the alternate embodiment shown in FIGS. 8, 8*a* each of the mechanisms 34 (of FIGS. 1–4) are replaced by pin 62. The pin 62 is mounted in a bushing 64 carried by the support 24. The track assembly 14', including its transition sections (not shown), is modified to have slotted tracks 18' (as opposed to the rail type tracks 18 of assembly 14). The pin 62 mates with a selected slot of track 18' in a modified track assembly 14'. The pins 62 are located in vertically spaced relation to the plane of the supported image carrier sheet to locate such sheet in the plane P' when the pins engage a corresponding selected track slot. For example, the pin in FIG. 8 is located to position the respective supported sheet in plane P' when the pin engages the second track slot from the top; and the pin in FIG. 8*a* is located to position the respective supported sheet in plane P' when such pin engages the bottom-most track slot. The pins 62 simplify the construction of the mechanism for mounting the image carrier sheet for movement in the track assembly.

The invention has been described in detail with particular reference to preferred embodiments thereof, but it will be understood that variations and modifications can be effected within the spirit and scope of the invention.

We claim:

1. For use in an electrographic copier having a track assembly with multiple tracks defining a path associated with copier process stations through which discrete image carriers are moved to form developed images on such carriers, apparatus for mounting such image carriers on selected tracks of such track assembly for movement along said path, said apparatus comprising:

means for supporting image carriers in a substantially planar condition; and means, operatively associated with said supporting means, for engaging said selected tracks to mount such carriers on said tracks and to maintain such carriers, when moving along a portion of the path, in the same plane relative to that portion of the path regardless of the track engaged by said engaging means.

2. The invention of claim 1 wherein said supporting means is a plurality of substantially rectangular frames to which discrete image carriers are attached respectively.

3. The invention of claim 2 wherein said track engaging means includes a plurality of arms pivotably mounted on said frames, means for selectively setting the angular orientation of said arms relative to such frames, and a plurality of followers mounted on said plurality of arms respectively for engaging said selected tracks of the track assembly to support such image carriers in such plane.

4. The invention of claim 3 wherein said orientation setting means includes a plurality of sets of detents in said plurality of frames respectively, the detents of said sets being vertically spaced apart a distance equal to the distance between adjacent tracks to respectively correspond to the tracks of said track assembly, and means associated with said followers for selectively engaging selected ones of such detents.

5. The invention of claim 2 wherein said multiple tracks respectively comprise rails, and wherein said track engaging means includes a plurality of members supported on said plurality of frames respectively, and means carried by said members in vertically spaced relation to respective frames, for capturing selected rails to support such image carriers in such plane.

6. The invention of claim 5 wherein said capturing means comprises a pair of pins spaced apart a distance substantially equal to the width of a rail for capturing a rail therebetween.

7. The invention of claim 2 wherein said multiple tracks respectively comprise members defining slots, and wherein said track engaging means includes a plurality of pins supported on said plurality of frames respectively, said pins being vertically spaced relative to respective frames and adapted to be received in selected slots to support such image-carriers in such plane.

* * * * *